US006279293B1

(12) United States Patent
Ojala

(10) Patent No.: US 6,279,293 B1
(45) Date of Patent: Aug. 28, 2001

(54) INSULATED ROOF PANEL

(76) Inventor: Leo V. Ojala, 163 Zerah Fiske Rd., Shelburne Falls, MA (US) 01370

( * ) Notice: Subject to any disclaimer, the term of this patent is extended or adjusted under 35 U.S.C. 154(b) by 0 days.

(21) Appl. No.: 09/358,613

(22) Filed: Jul. 21, 1999

Related U.S. Application Data

(63) Continuation-in-part of application No. 08/985,517, filed on Dec. 5, 1997, now Pat. No. 5,953,883.

(51) Int. Cl.[7] ..... E04C 2/34; E04B 7/00

(52) U.S. Cl. ..... 52/794.1; 52/90.1; 52/95; 52/302.3; 52/407.3

(58) Field of Search ..... 52/90.1, 91.1, 52/91.3, 95, 302.3, 309.2, 309.9, 309.11, 309.14, 309.16, 406.1, 406.2, 406.3, 404.4, 407.3, 654.1, 787.1, 794.1, 802.1

(56) References Cited

U.S. PATENT DOCUMENTS

| | | | | |
|---|---|---|---|---|
| 2,192,933 | * | 3/1940 | Saborsky | 52/302.3 |
| 2,199,586 | * | 5/1940 | Bowser | 52/794.1 X |
| 3,086,323 | * | 4/1963 | Pine | 52/302.3 X |
| 3,305,986 | * | 2/1967 | Mathews | 52/794.1 X |
| 3,313,072 | * | 4/1967 | Cue | 52/302.3 |
| 4,329,827 | * | 5/1982 | Thorn | 52/794.1 X |
| 4,569,174 | * | 2/1986 | Bossany | 52/406.1 |
| 4,635,419 | * | 1/1987 | Forrest | 52/302.3 |
| 4,852,314 | | 8/1989 | Moore, Jr. . | |
| 5,220,760 | * | 6/1993 | Dimakie | 52/309.9 |
| 5,353,563 | * | 10/1994 | White | 52/309.16 X |
| 5,433,050 | | 7/1995 | Wilson et al. . | |
| 5,473,847 | | 12/1995 | Crookston . | |
| 5,505,031 | * | 4/1996 | Heydon | 52/794.1 X |
| 5,953,883 | * | 9/1999 | Ojala | 52/407.3 X |

OTHER PUBLICATIONS

Definition of "polyurethane" from Hawley's Condensed Chemical Dictionary, Eleventh Edition; pp. 944–945, 1987.*

* cited by examiner

*Primary Examiner*—Carl D. Friedman
*Assistant Examiner*—Kevin D. Wilkens
(74) *Attorney, Agent, or Firm*—Wood, Herron & Evans, LLP

(57) ABSTRACT

An insulated roof panel comprising a plurality of longitudinally extending spaced parallel web trusses secured to an inner sheathing and an outer sheathing. Each of the web trusses comprises at least one top cord, a bottom cord and a plurality of webs joining the cords together. A vapor barrier is sandwiched between the bottom cords of the web trusses and the inner sheathing. A layer of insulation extends upwardly from the vapor barrier a height less than the height of the insulated roof panel in order to allow air to flow over the insulation. Sleeves built in to the web trusses allow fasteners of a length less than the height of the panel to secure the roof panel to timber frame members.

20 Claims, 7 Drawing Sheets

INSULATED ROOF PANEL

CROSS REFERENCE TO RELATED APPLICATIONS

This application is a continuation-in-part application of U.S. patent application Ser. No. 08/985,517 filed Dec. 5, 1997 entitled "Insulated Wall Panel", now U.S. Pat. No. 5,953,883 which application is herein incorporated by reference in its entirety.

FIELD OF THE INVENTION

This invention relates to the manufacture and construction of roofing panels for residential, light commercial, commercial and industrial building construction.

BACKGROUND OF THE INVENTION

One popular type of home is what is considered in the construction industry a timber frame home. Timber frame homes are constructed of a plurality of heavy timber frame members and are designed so as to expose the timbers of the frame inside the home.

Traditionally a conventional light frame was built around or between the timber frame members, a layer of drywall secured to the inside surfaces of the light frame members, fiberglass insulation inserted between the light frame members, and then covered on the outside with siding. However, this method of construction was slow, labor intensive and costly. In addition, the resulting building or structure was not energy efficient because the insulation was interrupted every 16 inches by a light frame member (stud) or rafter allowing heat to easily escape and cold to enter the building at these points.

In the 1970's, structural insulating panels, commonly known in the industry as stress-skin panels, were developed for use in the residential construction of timber frame homes. The stress-skin panels are nailed to the exterior of the timber frame members leaving the frame exposed inside the home, thus creating an attractive appearance. These stress-skin panels used in conjunction with a timber frame replaced in many applications the standard 2×4 construction of homes. The stress-skin panels were considered stronger than 2×4s and were considered to provide better insulating capability.

A stress-skin panel is a panel comprising an outer skin, an inner skin and several inches of rigid foam insulation sandwiched between the two layers of sturdy sheathing material or skins. The outer and inner skins may be constructed of a plurality of materials, but are usually made of plywood, waferboard or oriented strand board (OSB). The foam insulation core located between the two skins is expanded polystyrene (commonly called EPS) or urethane foam, typically 3 ½" thick. These panels are typically prefabricated before being installed as part of the walls and roofs of structures like homes, commercial offices, etc.

Because both plywood and OSB are commercially available only in certain size sheets, the size of the stress skin panels is limited. For example, plywood is typically available in 4'×8' sheets while OSB is typically available in larger size sheets (up to 8'×24'). Therefore, the size of the stress-skin panels is limited to between 4'×8' and 8'×24'. Due to the limited size of the stress-skin panels, a large number of panels must be used in order to completely construct a roof or the perimeter walls of a building. Additionally, due to the weight of the stress-skin panels, a crane is often required to lift the stress-skin panels into place, particularly when the stress-skin panels are used to construct a roof. The relatively large number of stress-skin panels necessary to construct such a roof requires a large number of individual laborers and additionally requires a large amount of crane time (time that the crane is in use). Both of these requirements increase the cost of constructing a timber frame building using stress skin panels.

Stress-skin panels are manufactured by injecting a liquid urethane between the two skins and allowing the liquid urethane to expand between the skins, the urethane foam adhering to the inner surfaces of the skins without any other adhesives. Alternatively, if the foam insulation is EPS, the foam insulation is glued or adhesively secured to the outer sheathing layers or skins with a urethane glue. With either type of insulation, over time the adhesive or bond used to secure the foam insulation to the two skins of the panel may deteriorate if exposed to extreme temperature fluctuations causing the inner and outer skins of the panel to sheer apart from the foam insulation.

In addition, some type of sealant must be inserted along the joints between adjacent stress-skin panels in order to reduce air and moisture flow through these joints. Alternatively, thin horizontal splines may be used between panels to minimize thermal breaks. Improperly sealed joints or seams can allow moisture to collect and the trapped moisture can eventually cause the materials of the stress-skin panels to swell and deteriorate.

These stress-skin panels are secured to the heavy timber frame of a structure with long nails or screws known in the industry as pole, barn spikes or deck screws. The length of these nails or screws must be greater than the depth of the stress-skin panels so that the panels may be secured to the exterior surfaces of the timber frame members of the structure, the nails or screws passing through the entire stress-skin panel and into the timber frame members.

In cold climates where a large temperature differential exists between the exterior surface of panels and the interior of the structure, the nails or screws running through the panels may conduct heat and may cause condensation at the heads of the nails or screws. Over time, this condensation may cause the exterior layer of the stress-skin panels to rot which may eventually cause structural failure of the panels.

In addition, utilizing stress-skin panels to construct a timber frame home is expensive. Because the interior layers or skins of the stress-skin panels are visible from inside the building, another layer of material such as drywall or wood paneling is typically placed over and attached to the inner layer or skin of the stress-skin panels in order to make the inner surfaces of the panels aesthetically pleasing. Similarly, a layer of siding or other material is usually placed over the outer skins of the stress-skin panels.

If conventional stress-skin panels are used to construct the roof of a building, asphalt-saturated felt (known in the industry as tar paper) is applied in layers over the outer skins of the stress-skin panels and roofing material such as shingles attached directly to the outer skins of the panels. A roof constructed in such a manner does not vent properly. Due to excessive heat buildup between the roofing materials and the stress-skin panels due to the insulation inside the panels, the stress-skin panels may deteriorate. Hence, the useful life of a roof constructed of stress-skin panels is limited.

One prefabricated roof panel which attempts to better ventilate a roof made from a plurality of panels is disclosed in U.S. Pat. No. 4,852,314. This patent discloses a generally planar deck spaced above a stress-skin panel by a plurality of spaced spacers between which air may flow up the roof and escape. The roofing panels disclosed in this patent have a substrate of rigid foam material sandwiched between two facer boards made of fiberglass. Conventional roofing materials such as asphalt-saturated felt and asphalt shingles are secured to the substantially planar deck portion of the panels. Although the roofing panels disclosed in this patent do provide ventilation, the panels are limited in size to the standard sizes of sheets of plywood or OSB. Additionally, these roofing panels must be attached to the rafters of a roof with nails or screws of a length greater than the depth of the panels. Therefore, the utility and longevity of such roofing panels are limited for the reasons described above.

In light of the aforementioned drawbacks of using stress-skin panels to construct the roof of a building, a need exists for a roofing panel which is structurally sounder than stress-skin panels and will not deteriorate or degrade over time due to seasonal temperature fluctuations. A need also exists for a roofing panel which may be made of a larger size than the size of one sheet of plywood or OSB so that the roof of a building may be constructed of a lesser number of panels than has heretofore been possible. Also a need exists for a roofing panel which does not require the use of fasteners or nails of a length greater than the depth of the panel in order to secure the panel to timber frame members such as rafters, purlins, plates or other timber frame members.

Therefore, it has been one objective of the present invention to provide an insulated roof panel less susceptible to degradation over time than stress-skin panels.

It has a further objective of the present invention to provide an insulated roof panel which does not require long screws or nails to pass through the panel in order to secure the insulated roof panel to the timber frame members of a building.

It has been a further objective of the present invention to provide an insulated roof panel which may span greater distances than stress-skin panels.

It has been a further objective of the present invention to provide an insulated roof panel which may be customized for particular applications.

SUMMARY OF THE INVENTION

The invention of this application which accomplishes these objectives comprises an insulated roof panel having a longitudinal dimension and a transverse dimension. The longitudinal dimension is preferably greater than the transverse dimension, so the insulated roof panel is generally rectangular. However, the insulated roof panel may be square as well. Additionally, the insulated roof panel has a top surface and bottom surface, the distance between the top and bottom surfaces of the insulated roof panel defining the thickness of the insulated roof panel.

The insulated roof panel of the present invention comprises a plurality of longitudinally extending web trusses built into the insulated roof panel. Each of these web trusses comprises at least one top cord, a bottom cord spaced from the top cord or cords and a plurality of webs joining the cords together. The webs are oriented such that they form an acute angle with the top and bottom cords which are parallel to one another.

In the preferred embodiment of the present invention, each web truss forming a part of the insulated roof panel has a top cord, a bottom cord and a plurality of webs joining the top and bottom cords. In another embodiment of the present invention, each insulated roof panel has a plurality of web trusses different than the web trusses of the preferred embodiment. Each of these web trusses has a pair of spaced parallel top cords, a bottom cord spaced from the top cords and a plurality of webs joining the bottom cord to the top cords. Although two different configurations of web trusses are illustrated and described in this application, other configurations of web trusses may be incorporated into the roof panel without departing from the spirit of the present invention.

The insulated roof panel of the present invention further comprises an inner sheathing secured to the lower surfaces of the bottom cords of the web trusses and an outer sheathing secured to the top surfaces of the top cords of the web trusses. The bottom surface of the inner sheathing comprises the bottom surface of the insulated roof panel, and similarly the top surface of the outer sheathing comprises the top surface of the insulated roof panel. The inner sheathing is preferably made of several pieces of tongue and groove finished wooden panels joined together but may be made of other materials such as gypsum wall board having a preapplied finish. Once the insulated roof panels of the present invention are secured to the rafters, purlins or other timber frame members of a timber frame building, the inner sheathing will be visible to persons inside the building and therefore preferably is aesthetically pleasing, particularly if the building is a residential home.

On the other hand, the outer sheathing of the insulated roof panel of the present invention is not visible to persons inside the building. The outer sheathing is preferably plywood, OSB or any other type of corrugated roof decking material but may be any other material. Conventional roofing materials such as asphalt-saturated felt and asphalt shingles are secured to the outer sheathing in order to complete the roof.

A vapor barrier preferably comprising a sheet of plastic extends the full transverse and longitudinal dimensions of the insulated roof panel and is sandwiched between the bottom cords of the web trusses and the inner sheathing. The vapor barrier is generally planar. However, the vapor barrier may additionally be wrapped around a pair of outermost web trusses, an insulation dam or other structure and secured thereto. The vapor barrier is impervious to moisture, and thus functions to protect the interior of the insulated roof panel of the present invention, and more particularly the insulation located inside the insulated roof panel.

A layer of insulation is located between the vapor barrier and the outer sheathing. The layer of insulation has a top surface which is preferably covered with a mesh member spaced from the outer sheathing in order to allow air to flow over the insulation and ventilate the insulated roof panel. The insulation may be any type of insulation, but is preferably non-rigid insulation which does not require the use of urethane glues or other environmentally harmful products.

An insulation dam extends at least partially around the perimeter of the roof panel and confines the insulation. The insulation dam comprises a pair of opposed longitudinally extending side dam members and a pair of opposed transversely extending end dam members which define a cavity in which the insulation is located. The insulation dam is preferably made of four individual planar members, the side dam members of the insulation dam being secured to the outermost web trusses of the insulated roof panel. However, the insulation dam may be a unitary rectangular member or a pair of L-shaped members. The insulation dam contains the insulation but still allows air to flow over the top of the insulation and through the panel to properly vent the roof panel. The height of at least two of the insulation dam members is less than the height of the insulated roof panel and preferably equal to the distance from the inner sheathing to the top surface of the insulation. Thus a gap exists between the outer sheathing and the top surface of the insulation dam members, allowing air to flow over the insulation and vent moisture away from the insulation.

The insulated roof panel of the present invention also has a plurality of hollow sleeves extending through the insulated roof panel. The hollow sleeves enable fasteners of a lesser length than the height of the insulated roof panel to be used to secure the insulated roof panel to the timber frame members. Because the shorter fasteners do not extend entirely through the insulated roof panels, thermal conductivity through the fasteners is limited. Therefore condensation does not occur at the heads of the fasteners causing deterioration of the outer sheathing of the roof panels as with stress skin panels. Consequently, the useful life of the roof panels is prolonged.

In the preferred embodiment of the present invention, a pair or more of spaced brackets are used to secure each web truss to the timber frame members of the building. Each bracket extends over the bottom cord of one of the web trusses of the insulated roof panel and has a pair of holes therethrough. Above each bracket hole is a hollow sleeve extending downwardly from the upper surface of the insulated roof panel. Each hollow sleeve is preferably made of cardboard but may be made of any material. Each hollow sleeve has two open ends and is adapted to allow a fastener to pass through the hollow sleeve. In order to secure the web truss to the timber frame members, each fastener is passed through one of the hollow sleeves, through one of the bracket holes and through the inner sheathing before entering one of the timber frame members. Once the fastener has passed through the hollow sleeve and into the timber frame member so that the head of the fastener is contacting the bracket, the sleeve is filled with insulation and plugged.

In an alternative embodiment of the present invention brackets are not used to secure the roof panel to the timber frame members. In this embodiment, at least one hollow sleeve extends downwardly between the two top cords of each web truss and rests upon the top surface of the bottom cord of the web truss. Each hollow sleeve is adapted to allow a fastener to pass through the hollow sleeve and into a hole formed through the bottom cord of the web truss in order to secure the web truss to a timber frame member such as a rafter. Once the fastener has passed through the sleeve and the head of the fastener is resting on the top surface of the bottom cord of the web truss, the sleeve is filled with insulation and plugged.

In either embodiment, because insulation is inserted into the sleeves of the roof panel after fasteners have passed through the sleeves, the layer of insulation of the insulated roof panel is not interrupted. The web trusses of each roof panel provide strength and transfer roof loads onto the timber frame members. These and other objectives and advantages of the present invention will be more readily apparent from the following description of the drawings:

DETAILED DESCRIPTION OF THE PREFERRED EMBODIMENT

Figure 1:
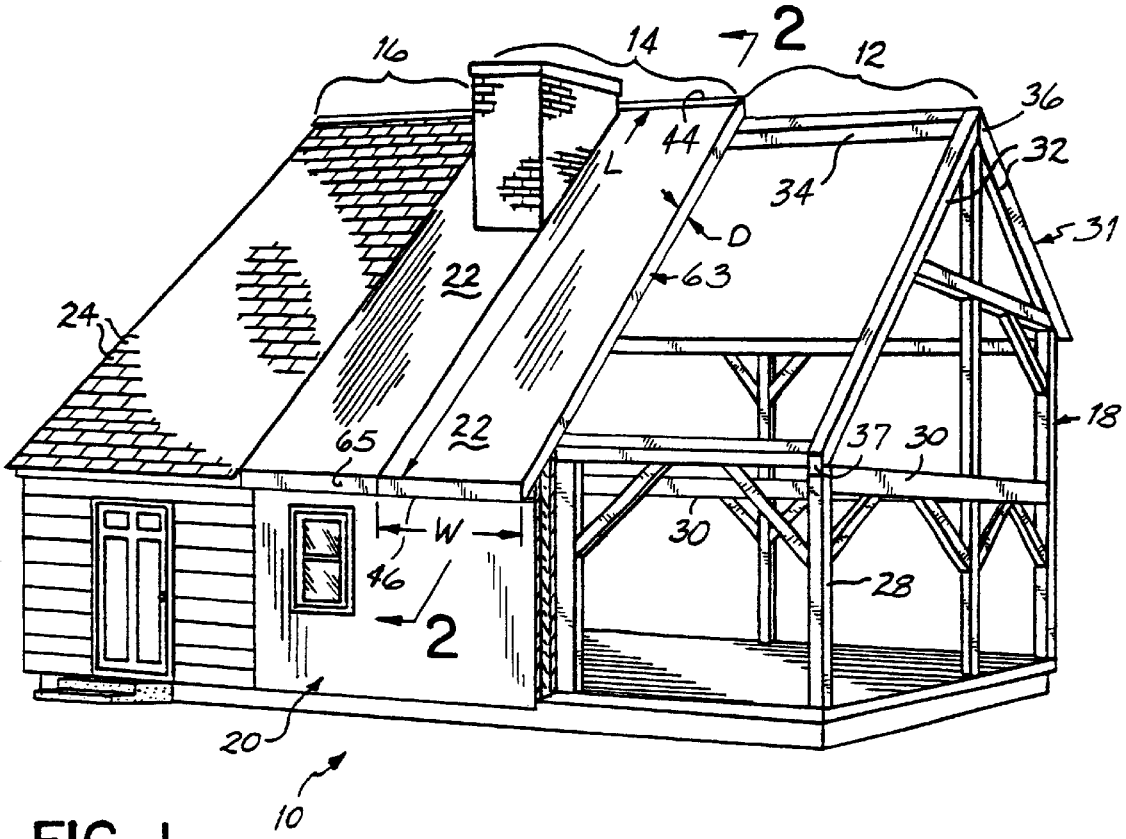
FIG. 1 is a perspective view of a home built using heavy timber frame construction divided into thirds, one third illustrating the timber frame itself, a second third illustrating two insulated roof panels of the present invention secured to the timber frame and the remaining third illustrating a finished home.

Referring to the drawings, and particularly to FIG. 1, there is illustrated a conventional timber frame home 10. For illustration purposes, the home is divided into thirds: a first third 12, a second third 14 and a last third 16 illustrating the progression of a home during construction of the home. The first third of the home 12 (seen in FIG. 1 as the rightmost third of the home) illustrates the frame 18 of a conventional timber frame home. The second third 14 (the middle third as seen in FIG. 1) illustrates an insulated wall panel 20 and a pair of insulated roof panels 22 of the present invention secured to the timber frame 18. The last third 16 of the home (seen to the left in FIG. 1) illustrates shingles 24 secured to the roof panels 22 of the present invention. Therefore, moving from right to left in FIG. 1, the different phases of construction of a timber frame home are illustrated to aid in the reader's understanding of the insulated roof panel of the present invention.

A timber frame home starts with a conventional wooden timber frame 18 and, more particularly, with spaced vertical timber frame members 28 which may be 6×8s or other sized lumber typical in the timber framing industry. These vertical members 28 are typically spaced apart from one another either 12, 14 or 16 feet but may be spaced apart any distance. Connecting the tops of the vertical frame members 28 are horizontal frame members or girts 30 which go around the periphery of the building. Like the vertical frame members 28, these horizontal frame members may be 6×8s or any other sized members. Lastly, the timber frame 18 of the home has a roof supporting portion 31 which includes a pair of opposed endmost rafters 32 at each end of the building which are used to support the roof of the home. Each pair of opposed rafters 32 assume an inverted V-shaped configuration. One end 36 of each rafter 32 is joined to a horizontal ridge beam 34. Each rafter 32 is also secured to one of the girts 30 proximate the opposite end 37 of the rafter.

Figure 1A:
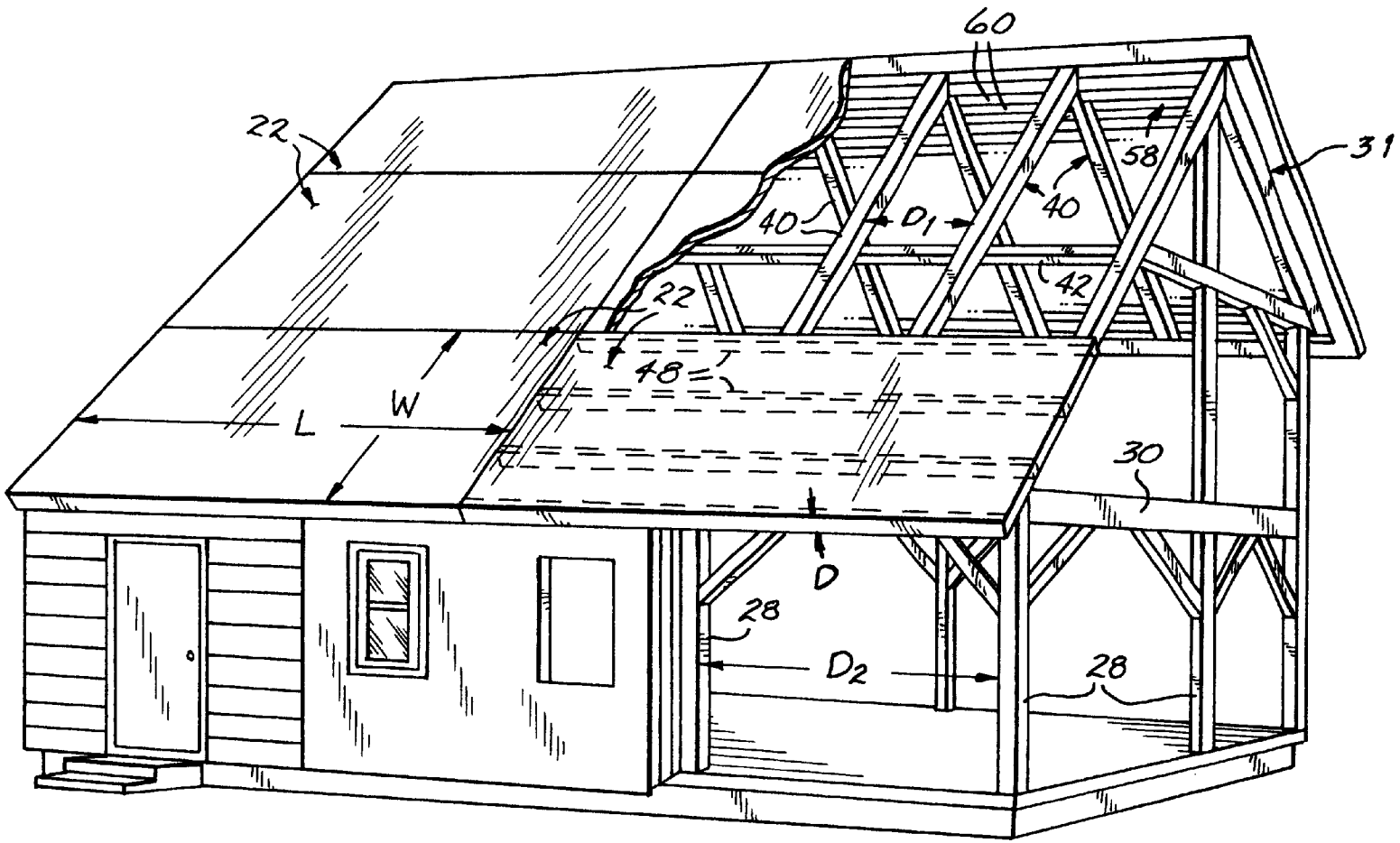
FIG. 1A is a perspective view of a home constructed with the insulated roof panels of the present invention being horizontally oriented and secured to multiple rafters of a timber frame.

As illustrated in FIG. 1A, roof supporting portion 31 of the timber frame 18 may take on numerous different configurations. FIG. 1A illustrates a roof supporting portion 31 having a plurality of spaced generally parallel rafters 40. A pair of opposed rafters have an inverted V-shape. Multiple rafters 40 support each roof panel 22. Each rafter 40 is secured to one of the horizontal timber frame members 30 and to the ridge beam 34. The distance $D_1$ between adjacent rafters 40 is typically either 8, 14, 16 or 20 feet but may be any distance. Typically the distance $D_1$ between adjacent rafters 40 is less than the distance $D_2$ between adjacent vertical members 28 of the timber frame. Extending generally horizontally parallel the ridge beam 34 and the girts 30, may be one or more purlins 42. The number of purlins, rafters or other timber frame members making up the roof supporting portion of the timber frame may vary from project to project and is not intended to be limited by this application.

Referring to the middle third 14 of the home 10 of FIG. 1, each of the insulated roof panels 22 of the present invention is illustrated as being generally vertically oriented, extending from the peak 44 of the roof to the eave 46 of the roof (below the ends 37 of the rafters 32). Oriented in such a manner, each of the roof panels 22 is secured to the ridge beam 34 and one of the girts 30 (see FIG. 2).

Alternatively, as illustrated in FIG. 1A, the insulated roof panels 22 of the present invention may be generally horizontally oriented (extend from one side of the building to the other). In such an orientation, each insulated roof panel 22 spans across several rafters 40. Each roof panel 22 may extend only partially across the width of the roof as illustrated in FIG. 1A or may extend the entire width of the roof, depending on the size of the building. Preferably, each roof panel 22 is of a width W sufficient to extend between a pair of adjacent horizontal timber frame members (either the ridge beam, purlins or girts) so that the roof panel 22 may be secured to the horizontal timber frame members as well as the rafters 40. Depending on the application, the insulated roof panels 22 of the present invention may be secured to either horizontal timber frame members such as girts 30, purlins 42, or rafters 40 or both horizontally oriented timber frame members and rafters.

As seen in FIGS. 1 and 1A, each insulated roof panel 22 has a fixed transverse dimension or width W, a fixed longitudinal dimension or length L and a fixed depth or thickness D. Each insulated roof panel 22 is built to custom size for a particular project. For example, the roof panels illustrated in FIG. 1 have a longitudinal dimension or length greater than the distance between the ridge beam 34 and the girt 30. Each of the insulated roof panels 22 illustrated in FIG. 1A has a longitudinal dimension or length approximately equal to the distance between four rafters 40.

The depth D of the insulated roof panel 22 of the present invention may be any distance depending on the insulating capability or R value desired and the type of insulation used inside the panel.

Figure 4:
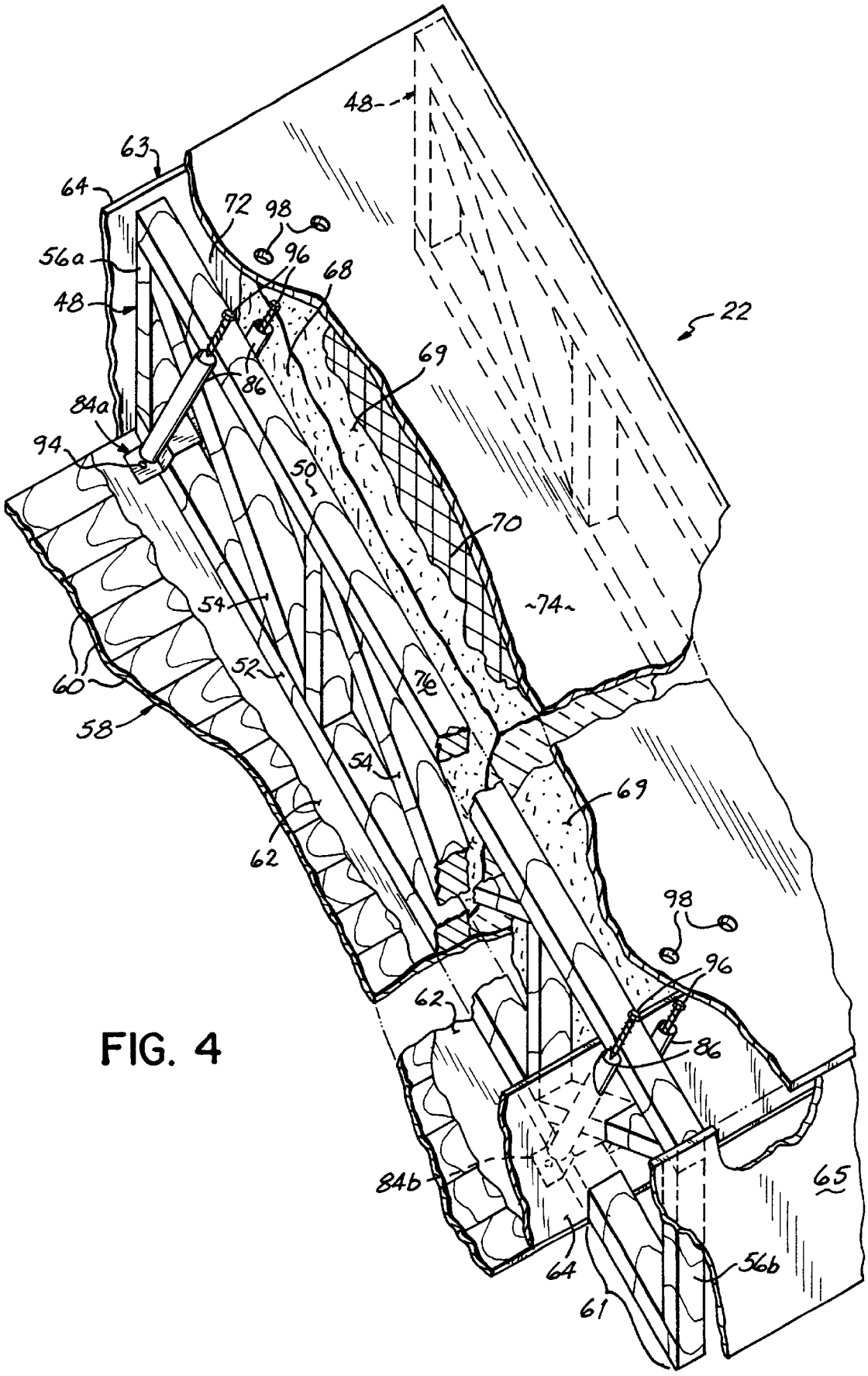
FIG. 4 is a disassembled, partially broken away perspective view of a portion of the preferred embodiment of the insulated wall panel of the present invention.

Referring now to FIG. 4, the components of each insulated roof panel 22 will now be described in detail. FIG. 4 illustrates a portion of the preferred embodiment of roof panel of the present invention. This embodiment of roof panel comprises a plurality of spaced generally parallel longitudinally extending web trusses 48 (only one being fully shown). The insulated roof panel preferably has between 4 and 7 spaced parallel web trusses (see FIG. 1A) but may contain any number of longitudinally extending web trusses 48 depending upon the size and desired application of the insulated roof panel. Each web truss 48 comprises a top cord 50, a bottom cord 52 and a plurality of webs 54, each web 54 extending between the upper and lower cords 50,52. Lastly, each web truss 48 comprises a pair of outermost end members 56*a*, 56*b* each end member 56*a*,56*b* connecting the top and bottom cords 50,52, respectively, and being generally perpendicular to those same top and bottom cords. Each of the top and bottom cords is preferably a 2×4 member or stud which is laid on the flat as illustrated in FIG. 4. Each of the webs 54 is illustrated as being laid on the flat as well so that the web truss 48 has a uniform width (all of the individual members of the web truss having the same width). Alternatively, the webs 54 may be oriented so that they are of a narrower width than the width of the top and bottom cords of the web truss. Although the web trusses 48 are preferably made of wood, they may be made of other materials as well without departing from the spirit of the invention of this application. The dimensions of the web trusses may vary from application to application.

Figure 2:
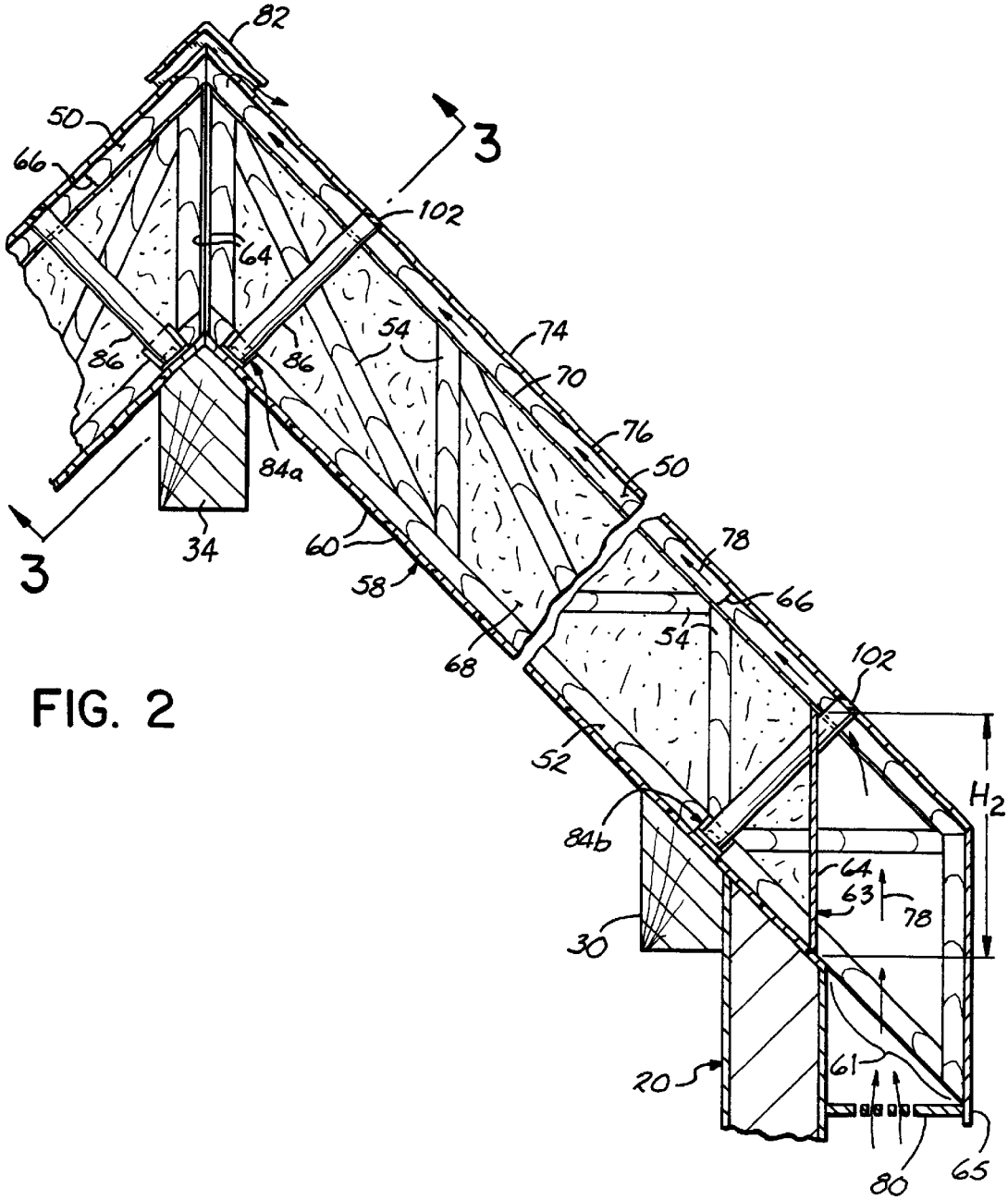
FIG. 2 is a view taken along the line 2—2 of FIG. 1.
Figure 3:
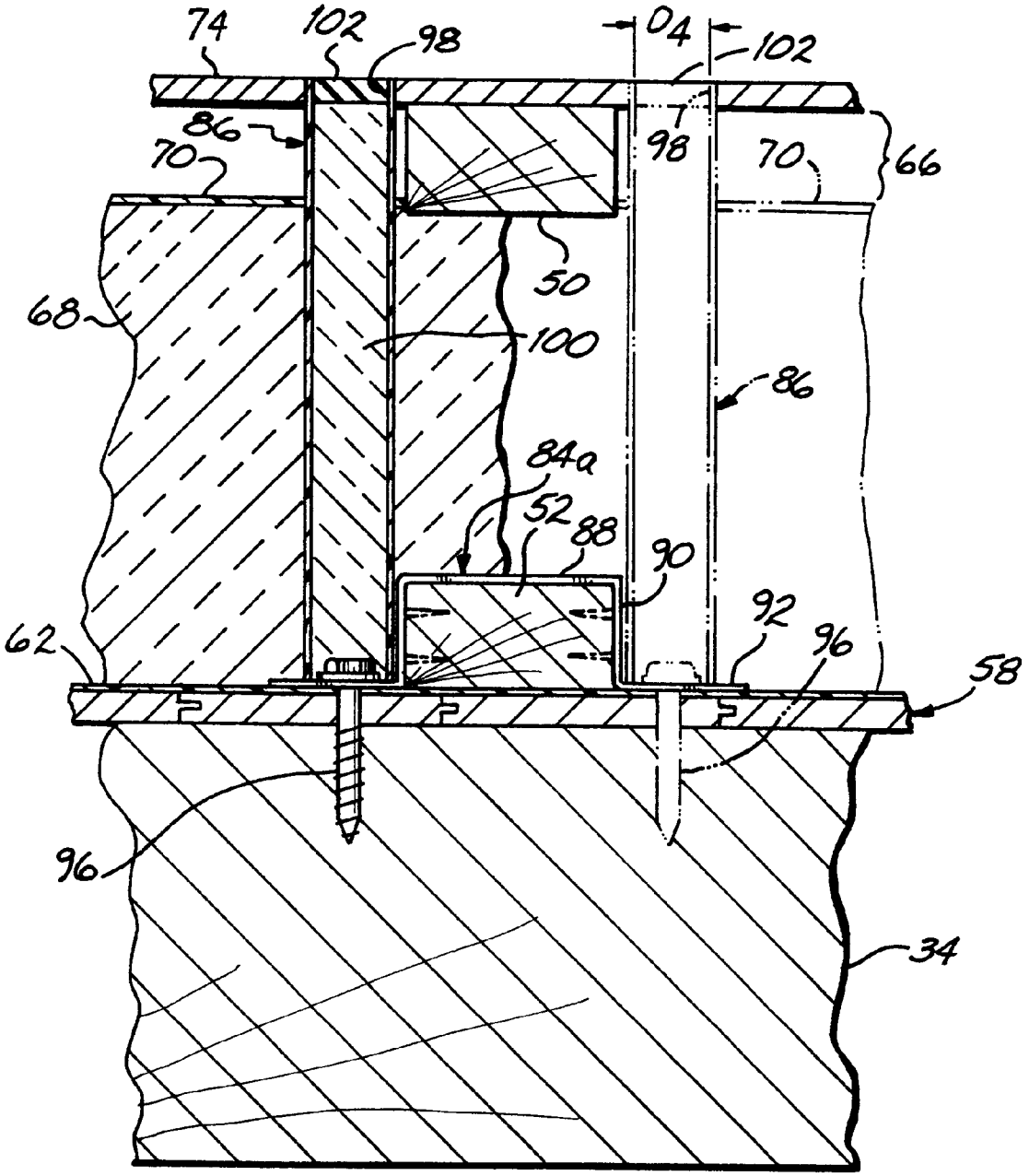
FIG. 3 is a view taken along the line 3—3 of FIG. 2.

Another component of the insulated roof panel of the present invention is an inner sheathing 58. The inner sheathing 58 is secured to the lower surface of the bottom cords 52 of each of the web trusses 48 of the insulated roof panel. As best illustrated in FIGS. 2–4, the inner sheathing 58 is preferably a plurality of finished tongue and groove boards 60 which may be easily connected together and create an attractive, aesthetically pleasing inner surface to the wall panel. This layer of inner sheathing 58 may be other materials such as gypsum wall board, but because it is visible from the inside of the building, it is preferably an aesthetically pleasing material. As illustrated in FIG. 4, the inner sheathing 58 may not extend the entire length or longitudinal dimension of the roof panel, leaving a gap 61 through which air flows (see FIG. 2).

Another component of the insulated roof panel of the present invention is a vapor barrier 62. The vapor barrier 62 is sandwiched between the inner sheathing 58 and the bottom cords 52 of the web trusses 48 of the insulated roof panel as illustrated in FIGS. 3–6. The vapor barrier 62 extends the entire length and width of the insulated roof panel. Additionally, if desired, the vapor barrier 62 may extend upwardly beyond the length and width of the insulated roof panel and be attached to either the inside surface or outside surface of the insulation dam members 64.

The insulation dam 63 comprises four dam members 64, is generally rectangular and surrounds the insulation of the insulated roof panel. The dam members 64 are preferably made of wood but may be made of any other material. The insulation dam members 64 extend upwardly from the inner sheathing 58 of the insulated roof panel. At least two of the individual dam members 64 (sides of the dam) are of a height less than the height of the insulated roof panel so as to leave an air gap 66 (best illustrated in FIG. 2) above the insulation dam members. At least one of the dam members may extend the full height of the insulated wall panel depending on the air flow desired.

As illustrated in FIGS. 2–4, an outside wall 65 is secured to the end members 56*b* of the web trusses 48. This outer wall 65 extends the entire thickness of the insulated roof panel 22, unlike the insulation dam members 64.

The vapor barrier 62 is preferably made of plastic such as polyethylene and is preferably impervious to water vapor and air. One such type of vapor barrier is an 8 millimeter stabilized polyethylene called TENOARM™ manufactured by Treleborg Industries located in Stockholm, Sweden and is distributed in the United States by Resource Conservation Technology of Baltimore, Maryland.

Referring back to FIG. 4, a layer of insulation 68 extends upwardly from the vapor barrier 62 and has an upper surface 69. The upper surface 69 of the insulation 68 may be covered with a mesh member 70. The layer of insulation 68 extends along the entire length and width of the insulated roof panel and fills the areas between the webs and top and bottom cords of the web trusses of the present invention. The insulation is contained within a cavity 72 defined by the insulation dam 63 extending at least partially around the perimeter of the insulated roof panel. The insulation 68 may be cellulose insulation or conventional fiberglass insulation or any other type of insulating material. No adhesive is required to keep the insulation in the cavity 72, unlike stress-skin panels.

The last component of the insulated roof panel is an outer sheathing 74 which is secured to the upper surfaces 76 of the top cords 50 of the web trusses. The outer sheathing 74 is preferably plywood, oriented strand board or corrugated roof decking but may be other materials as well.

As best illustrated in FIG. 2, the insulated roof panel of the present invention allows air to flow over the top of the layer of insulation 68 in order to properly ventilate the insulated roof panel. The mesh member 70 lays on top of the layer of insulation 68 and is spaced below the outer sheathing 74 so as to provide air spaces or air channels between the top cords of the web trusses of the present invention. Thus, as illustrated by the arrows 78 in FIG. 2, air flows upwardly through a screen or other like protective member 80 between the bottom cords 52 of the web trusses 48 as illustrated in FIG. 4 (outside of the insulation dam member 64) until the air contacts the outer sheathing 74 at which point the air moves upwardly through an air channel between the top surface 69 of the insulation 68 and the outer sheathing 74 upwardly along the roof panel until it exits out of the roof panel below a roof vent 82 (see FIG. 2). Thus, the insulated roof panel of the present invention allows the insulation to breathe, thus preventing the deterioration of the insulation inside the roof panel. Additionally, air flowing along the air channel dissipates heat away from the roof.

As best illustrated in FIGS. 2–4, the preferred embodiment of roof panel of the present invention uses brackets 84*a,* 84*b* in order to secure each web truss 48 to the timber frame members. Each web truss 48 has at least a pair of brackets 84*a* and 84*b* for securing the web truss 48 to the timber frame members, each bracket extending over the bottom cord 52 of the web truss 48 and having a pair of holes 94 therein. As best illustrated in FIG. 3, each bracket 84*a,* 84*b* has a top portion 88 which sits above the bottom cord 52, a pair of downwardly extending side portions 90 extending down from opposite ends of the top portion 88 and a pair of opposite flanges 92 which extend outwardly from the lower edges of the side portions 90. A hole 94 is located in each flange 92 and sized so as to receive a fastener 96. The fasteners 96 are illustrated as being screws but may be nails or any other fastener. Although FIGS. 2–4 illustrate two brackets 84*a,* 84*b* per web truss 48, any number of brackets may be used to secure the web truss 48 to the timber frame members, depending upon the number and orientation of timber frame members.

As best illustrated in FIGS. 3 and 4 in the preferred embodiment of roof panel, a pair of sleeves 86 extend upwardly from the flanges 92 of each bracket 84*a*, 84*b*. Each sleeve 86 extends approximately the entire height of the insulated roof panel and communicates with a corresponding hole 98 formed in the outer sheathing 74. As best illustrated in FIG. 3, the outer sheathing 74 supports the upper end of the sleeve 86, thus preventing the sleeve 86 from falling over. Each sleeve 86 has an inner diameter $D_4$ sized so as to be slightly larger than the heads of the fasteners 96, enabling the fasteners 96 to pass downwardly through the interior of the sleeves 86 before being passed through the inner sheathing 58 and into the interior of one of the timber frame members of the timber frame 18. Once each fastener 96 is secured into the timber frame member, insulation 100 is placed inside the interior of the sleeve 86 before the corresponding hole 98 in the outer sheathing is plugged with a plug 102. Once the insulated roof panel 22 has been fully secured and all the holes 98 in the outer sheathing 74 plugged, conventional roofing materials may be secured to the insulated roof panel 22.

Utilizing the sleeves and brackets of the preferred embodiment of the present invention, fasteners of a length less than the height of the insulated roof panel may be used to secure the insulated roof panel to the timber frame. Additionally, because the hollow sleeves may be filled with insulation afer the fasteners are passed therethrough, the layer of insulation is not interrupted by the fasteners, thus providing a continuous layer of insulation across the length and width of the insulated roof panel.

Referring back the FIG. 2, the brackets and sleeves of the present invention allow a pair of fasteners to secure each web truss 48 to the ridge beam 34, and another pair of fasteners to secure the web truss 48 to one of the girts 30, thus providing a strong attachment of the insulated roof panel 22 to the timber frame 18.

Figure 5:
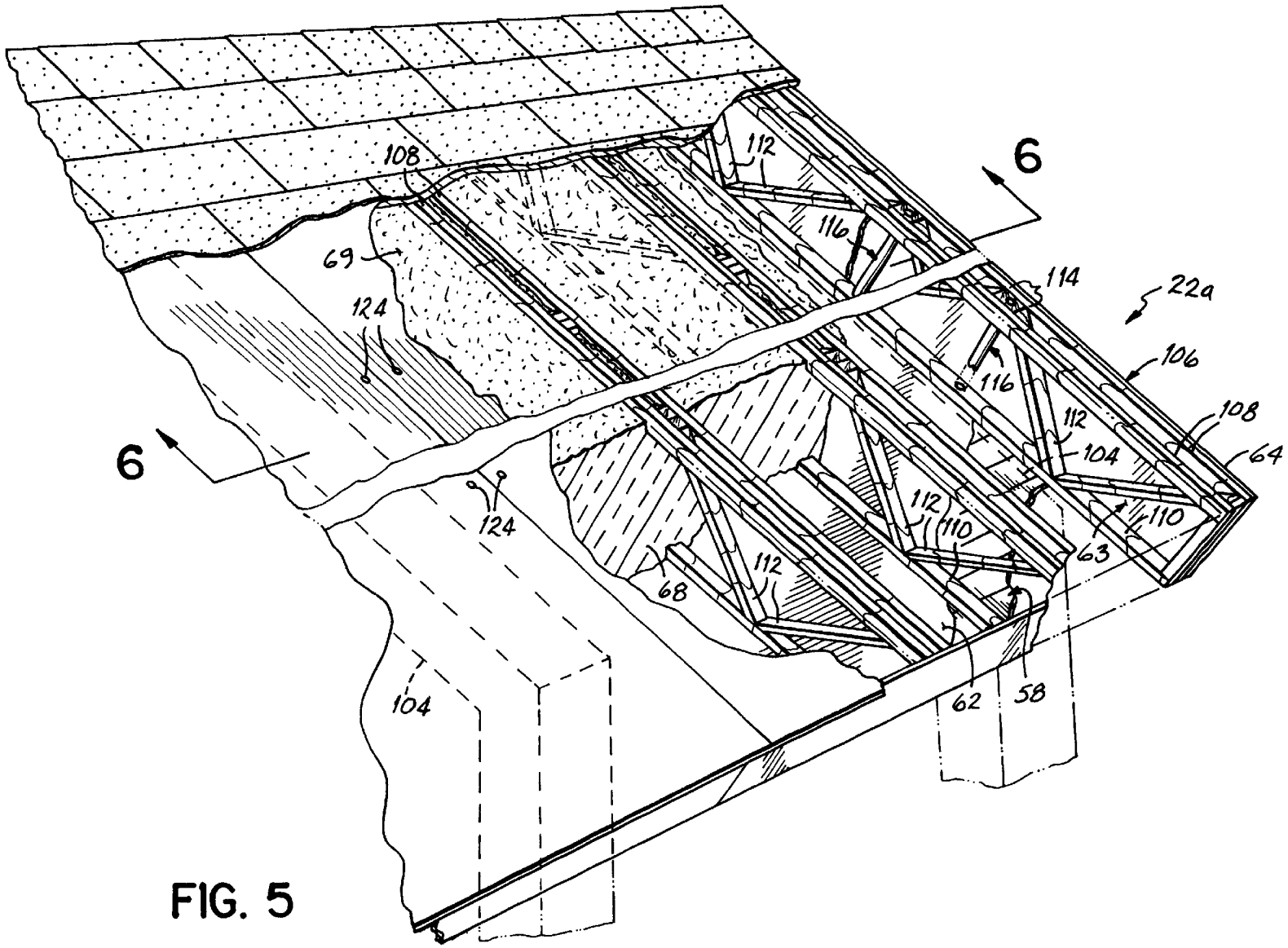
FIG. 5 is a perspective view partially cut away of one of the insulated roof panels of the present invention secured to a pair of rafters.
Figure 6:
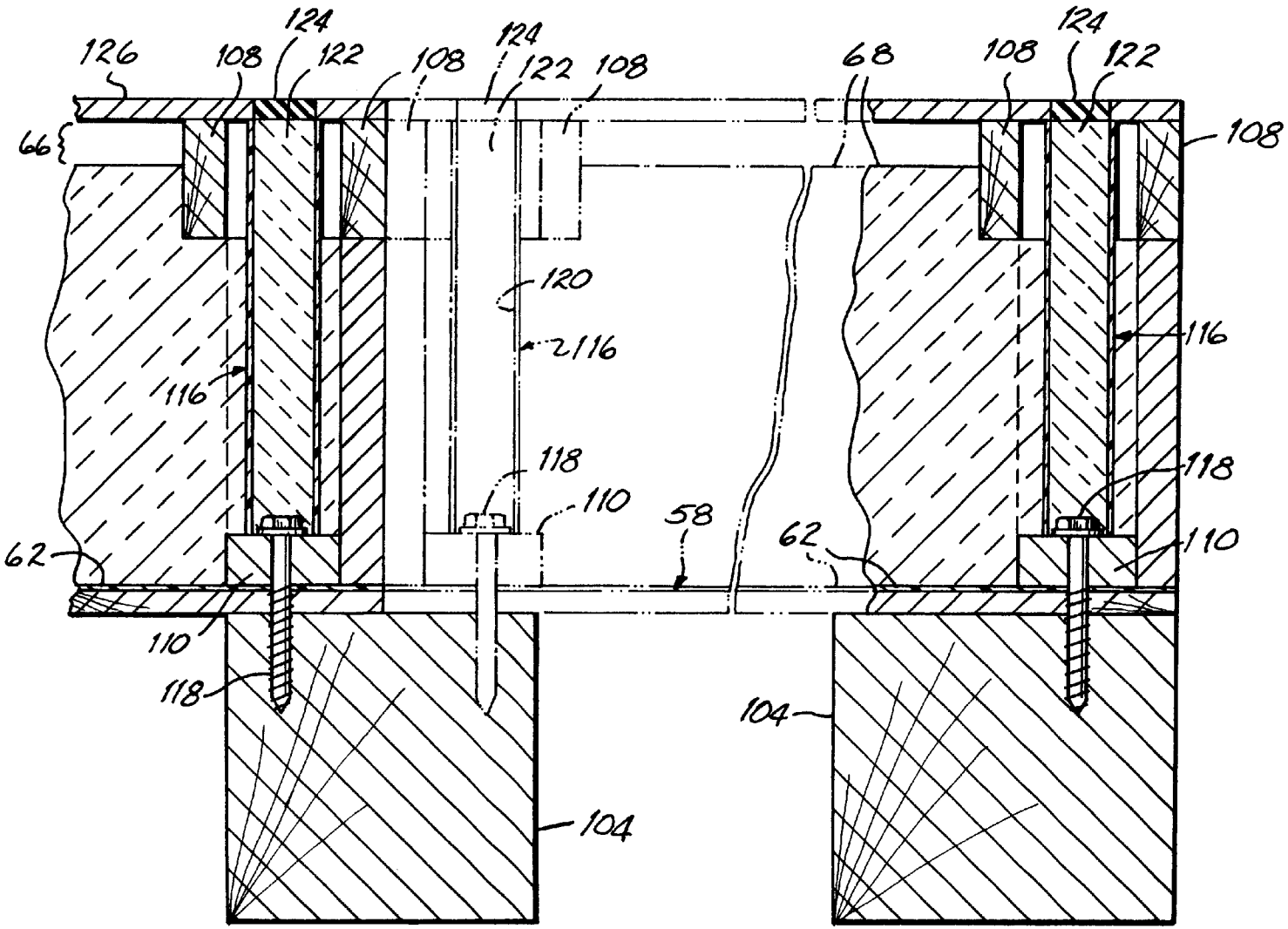
FIG. 6 is a partial cross-sectional view taken along the line 6—6 of FIG. 5.

Referring now to FIGS. 5 and 6, an alternative embodiment of insulated roof panel 22*a* of the present invention is illustrated and will be described. FIG. 5 illustrates the alternative embodiment of insulated roof panel 22*a* oriented peak to eave but secured to a pair of rafters 104 rather than a ridge beam and girt. This embodiment of insulated roof panel 22*a* utilizes the same components as in the preferred embodiment of roof panel, except each web truss 106 is configured slightly differently than the web trusses 48 of the preferred embodiment shown in FIGS. 2–4. In this alternative embodiment, each web truss 106 has a pair of top cords 108 spaced above a bottom cord 110, a plurality of webs 112 connecting the top cords 108 to the bottom cord 110. At location 114 (where two intersecting webs 112 meet) a sleeve 116 is located. These sleeves 116 are identical to the sleeves illustrated and described hereinabove. Each sleeve 116 is located between the pair of top cords 108 and extends downwardly to the bottom cord 110 of the web truss 106. Any number of sleeves may be built into this embodiment of roof panel 22*a* depending on the desired amount and location of fasteners. Like the sleeves and fasteners described in the preferred embodiment, the fasteners 118 are sized so as to pass through the hollow interior 120 of the sleeves 116 before being secured into one of the timber frame members 104 (see FIG. 6). The interior 120 of the sleeve 116 is filled with insulation 122 before the top of the sleeve is plugged with plug 124 and roofing materials placed over the top of the outer sheathing 126 of the roof panel.

Through the use of sleeves extending the height of the insulated wall panel of the present invention, fasteners of a length less than the height of the insulated wall panel may be used to secure the insulated wall panel to the timber frame members of a timber frame building. Additionally, the roof panel of the present invention may be quickly and inexpensively secured to the frame of a timber frame building. These and other objects and advantages will be apparent to those skilled in the art.

Although I have described only two preferred embodiments of the present invention, those skilled in the art will appreciate various modifications and changes which may be made to the insulated roof panel of the present invention, such as varying the number or location of sleeves and web trusses within an insulated wall panel. Therefore, I do not intend to be limited except by the scope of the following claims.

I claim:

1. An insulated roof panel adapted to be secured to timber frame members, said insulated roof panel comprising:

a plurality of spaced, parallel web trusses, each of said web trusses comprising at least one top cord, a bottom cord spaced from said at least one top cord and a plurality of webs joining said cords together, an inner sheathing secured to said bottom cords of said web trusses, a vapor barrier sandwiched between said bottom cords of said web trusses and said inner sheathing, an outer sheathing secured to said top cords of said web trusses, insulation located between said vapor barrier and said outer sheathing; and hollow sleeves extending through said insulated roof panel, each of said sleeves being sized to allow a fastener to pass through said sleeve and secure said insulated roof panel to one of said timber frame members.

2. The insulated roof panel of claim 1 wherein said insulation extends upwardly from said vapor barrier and has a top surface spaced from said outer sheathing in order to allow air to flow between said top surface and said outer sheathing.

3. The insulated roof panel of claim 1 wherein said insulation is non-rigid insulation.

4. The insulated roof panel of claim 1 wherein said insulation is contained by an insulation dam.

5. An insulated roof panel adapted to be secured to timber frame members, said insulated roof panel comprising:

a plurality of spaced, parallel web trusses, each of said web trusses comprising a top cord, a bottom cord spaced below said top cord and a plurality of webs joining said top and bottom cords, a plurality of brackets, each of said brackets extending over one of said bottom cords of one of said web trusses and having a pair of holes therethrough, an inner sheathing secured to said bottom cords of said web trusses, an outer sheathing secured to said top cords of said web trusses, insulation located between said inner sheathing and said outer sheathing, and a plurality of sleeves extending through said insulated roof panel, wherein each of said web trusses is adapted to be secured to one of said timber frame members with fasteners, each fastener passing through one of said sleeves, one of said holes in one of said brackets, and said inner sheathing before entering said one of said timber frame members.

6. The insulated roof panel of claim 5 further comprising a vapor barrier sandwiched between said inner sheathing and said bottom cords of said web trusses.

7. The insulated roof panel of claim 6 wherein said insulation extends upwardly from said vapor barrier to a mesh member spaced from said outer sheathing in order to allow air to flow between said insulation and said outer sheathing.

8. The insulated roof panel of claim 5 further comprising an insulation dam surrounding said insulation.

9. The insulated roof panel of claim 8 wherein the distance between a top surface of the outer sheathing and a bottom surface of the inner sheathing defines a height of the insulated wall panel and said insulation dam has a height less than the height of said insulated roof panel in order to allow air to pass through said insulated roof panel.

10. An insulated roof panel adapted to be secured to a pair of timber frame members, said insulated roof panel having a longitudinal dimension, a transverse dimension, a bottom surface and a top surface, said longitudinal dimension being greater than said transverse dimension and the distance between the top and bottom surfaces of the insulated roof panel defining the height of the insulated roof panel, said insulated roof panel comprising:

a plurality of spaced, parallel longitudinally extending web trusses, each of said web trusses comprising at least one top cord, a bottom cord spaced from said at least one top cord and a plurality of webs joining said bottom cord to said at least one top cord, an inner sheathing secured to said bottom cords of said web trusses, an outer sheathing secured to said top cords of said web trusses, a layer of insulation located between said inner sheathing and said outer sheathing, and a plurality of hollow sleeves built into said web trusses in order to allow fasteners of a length less than the height of said insulated roof panel to secure said insulated roof panel to said timber frame members.

11. The insulated roof panel of claim 10 wherein said hollow sleeves are filled with insulation after said fasteners have passed therethrough.

12. The insulated roof panel of claim 10 wherein said insulation is non-rigid insulation.

13. The insulated roof panel of claim 10 further comprising an insulation dam extending at least partially around the perimeter of said insulated roof panel.

14. The insulated roof panel of claim 13 wherein a portion of said insulation dam has a height less than the height of said insulated roof panel.

15. The insulated roof panel of claim 10 further comprising a vapor barrier sandwiched between said bottom cords of said web trusses and said inner sheathing.

16. The insulated roof panel of claim 15 wherein said vapor barrier is polyethylene.

17. The insulated roof panel of claim 15 wherein said layer of insulation extends between said vapor barrier and a mesh member spaced from said outer sheathing.

18. An insulated roof panel adapted to be secured to timber frame members, said insulated roof panel having a longitudinal dimension and a transverse dimension shorter than said longitudinal dimension, said insulated roof panel comprising:

a plurality of longitudinally extending spaced, parallel truss members, an inner sheathing secured to said truss members, an outer sheathing secured to said truss members, and insulation located between said inner sheathing and said outer sheathing wherein said inner sheathing extends less than said longitudinal dimension of said insulated roof panel and said outer sheathing extends less than said longitudinal dimension of said insulated roof panel to allow air to ventilate said insulated roof panel.

19. The insulated roof panel of claim 18 further comprising a vapor barrier sandwiched between said truss members and said inner sheathing.

20. The insulated roof panel of claim 19 wherein said insulation extends upwardly from said vapor barrier and has a top surface spaced from said outer sheathing to allow air to flow between said top surface of said insulation and said outer sheathing.

* * * * *